US006139410A

United States Patent [19]

Okumura et al.

[11] Patent Number: 6,139,410

[45] Date of Patent: Oct. 31, 2000

[54] MAIN BODY OF GRINDING ASSEMBLY FOR USE IN TRACK RAIL JOINT GRINDING APPARATUS

[75] Inventors: Yosiaki Okumura; Shinichi Okumura, both of Iwaki, Japan

[73] Assignee: Tohokugiken Industries Co., Ltd., Fukushima-Ken, Japan

[21] Appl. No.: 09/287,820

[22] Filed: Apr. 7, 1999

[30] Foreign Application Priority Data

May 1, 1998 [JP] Japan ..... 10-122175

[51] Int. Cl.[7] ..... B24B 23/00; B24B 27/08

[52] U.S. Cl. ..... 451/347; 451/429

[58] Field of Search ..... 451/28, 64, 66, 451/67, 69, 70, 429, 415, 109, 110, 111, 112, 177, 259, 260, 261, 262, 263, 347

[56] References Cited

FOREIGN PATENT DOCUMENTS 2543663 7/1996 Japan .

*Primary Examiner*—Derris H. Banks
*Attorney, Agent, or Firm*—Rodman & Rodman

[57] ABSTRACT

A main body 1 of a grinding assembly for use in a track rail joint grinding apparatus comprising a pair of grinding assemblies A, A' rotating around vertical shafts 5, 5' in mutually opposite directions so as to grind one and the other width-wise halves of a track rail R, comprises grinding blade supporting portions 3A to 3C which each constitute a recess edge 2 complementarily engaging with a head Ra of the track rail R, said grinding blade supporting portions being arranged at equiangular distances in the rotational direction of the vertical shaft 5, 5', and a suitable number of grinding blades 4*a* to 4*h* being detachably attached to grinding blade attaching portions 6*a* to 6*h* of each of the grinding blade supporting portions 3A to 3C. The grinding blade attaching portions 6*a* to 6*h* are provided on both edges of each of the grinding blade supporting portions 3A to 3C with respect to the rotational direction of the vertical shaft, respectively, and a set of grinding blade attaching portions 6*a* to 6*h* provided on one group of edges 3A' to 3C' of the grinding blade supporting portions 3A to 3C and a set of grinding blade attaching portions 6*a* to 6*h* provided on the other group of edges 3A" to 3C" of the grinding blade attaching portions 3A to 3C are arranged to correspond to each other and be opposed to each other with respect to the rotational direction of the vertical shaft 5, 5'.

11 Claims, 4 Drawing Sheets

MAIN BODY OF GRINDING ASSEMBLY FOR USE IN TRACK RAIL JOINT GRINDING APPARATUS

BACKGROUND OF THE INVENTION

1. Field of the Invention

The present invention relates to a main body of a grinding assembly for use in a track rail joint grinding apparatus wherein grinding blades are attached to the main body of the grinding assembly.

2. Related Art

There has been publicly known, in Japanese Patent No.2543663, a track rail joint grinding apparatus comprising a pair of grinding assemblies rotating around vertical shafts in mutually opposite directions so as to grind one and the other width-wise halves of a track rail, each of the grinding assemblies comprising grinding blade supporting portions which each constitute a respective recess edge complementarily engaging with a head of the track rail, said grinding blade supporting portions being arranged at equiangular distances in the rotational direction of the vertical shaft, and a suitable number of grinding blades being detachably attached to each of the grinding blade supporting portions. The grinding assemblies of this pair used in the grinding apparatus are different in construction from each other.

The above-mentioned related art requires provision of two types of grinding assemblies; namely, a first grinding assembly for grinding one width-wise half of the track rail, and a second grinding assembly for grinding the other width-wise half, respectively, which increases the cost of producing the track rail joint grinding apparatus.

SUMMARY OF THE INVENTION

It is therefore an object of the present invention to provide a main body of a grinding assembly for use in a track rail joint grinding apparatus, which is capable of being used for both width-wise (right and left) sides of a track rail by merely changing attaching positions of the grinding blades, thereby decreasing the cost of producing the track rail joint grinding apparatus.

To attain the above object, the present invention provides a main body of a grinding assembly for use in a track rail joint grinding apparatus comprising a pair of grinding assemblies rotating around vertical shafts in mutually opposite directions so as to grind one and the other width-wise halves of a track rail, the main body comprising grinding blade supporting portions which each constitute a respective recess edge complementarily engaging with a head of the track rail, said grinding blade supporting portions being arranged at equiangular distances in the rotational direction of the vertical shaft, and a suitable number of grinding blades being detachably attached to grinding blade attaching portions of each of the grinding blade supporting is portions, characterized in that the grinding blade attaching portions are provided on both edges of each of the grinding blade supporting portions with respect to the rotational direction of the vertical shaft, respectively, and a set of grinding blade attaching portions provided on one group of edges of said grinding blade supporting portions and a set of grinding blade attaching portions provided on the other group of edges of the grinding blade attaching portions are arranged so as to correspond to each other and be opposed to each other with respect to the rotational directions of the vertical shafts.

Further objects and advantages of the present invention will be apparent from the following description of a preferred embodiment of the invention as illustrated in the accompanying drawings.

DETAILED DESCRIPTION OF THE PREFERRED EMBODIMENT

The invention will now be described in detail with reference to FIGS. 1 to 5 showing an embodiment.

Figure 1:
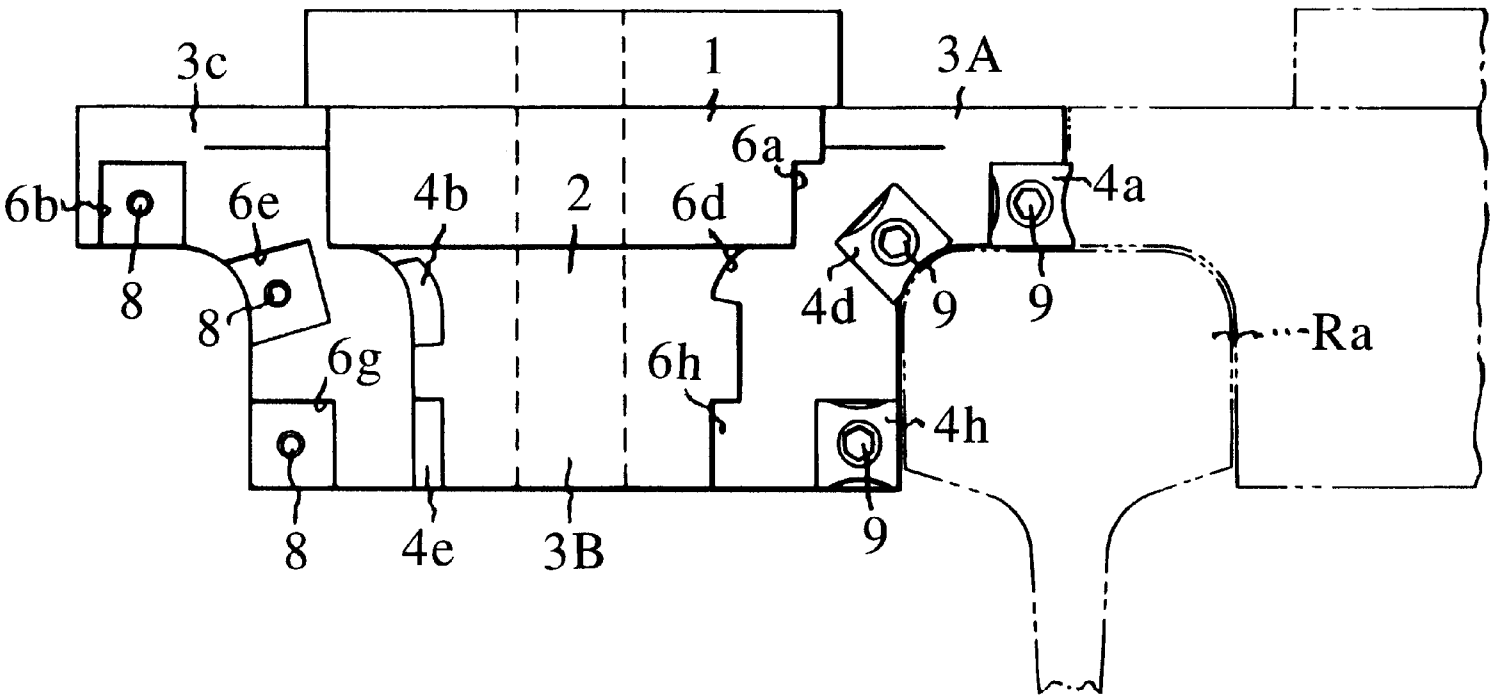
FIG. 1 is a front view of a main body of a grinding assembly of a track rail joint grinding apparatus according to an embodiment of the present invention.
Figure 2:
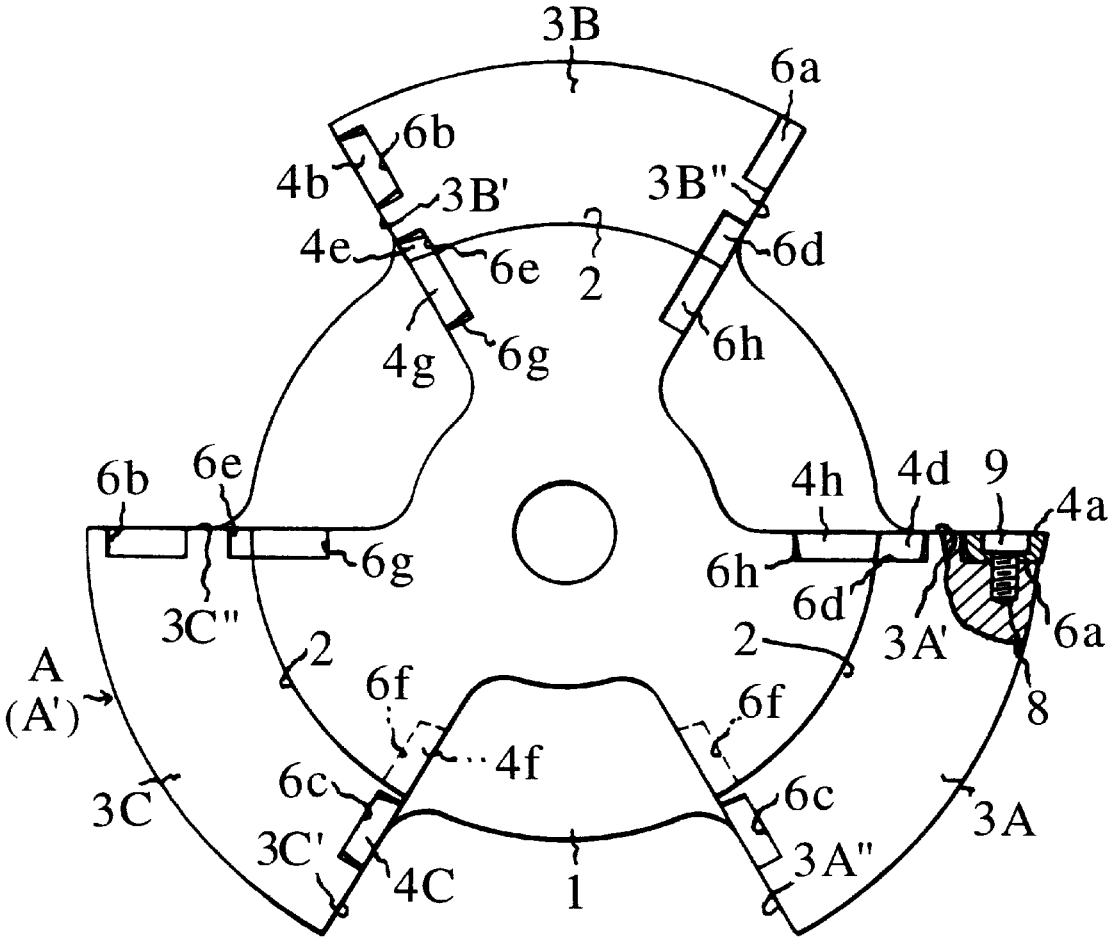
FIG. 2 is a partially cutaway bottom view of the main body of the grinding assembly.
Figure 3:
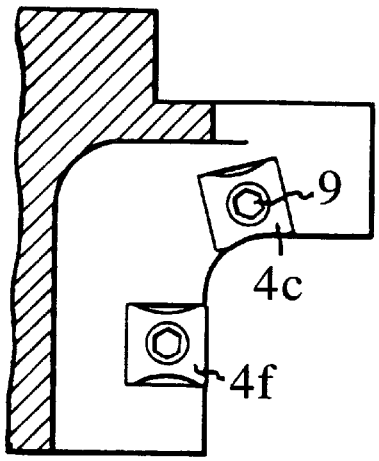
FIG. 3 is a partial sectional view of the main body.
Figure 4:
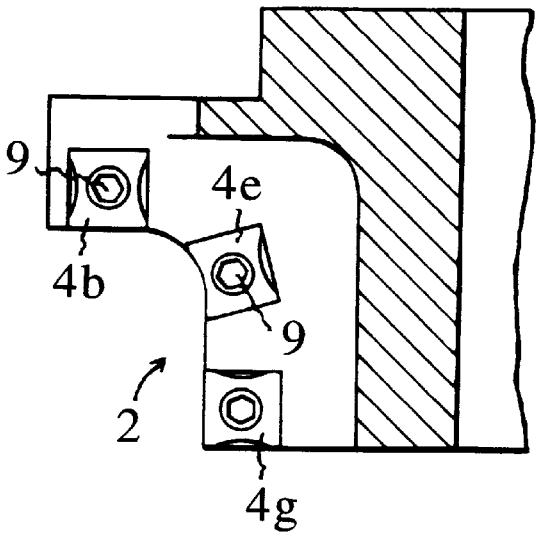
FIG. 4 is another partial sectional view of the main body.

In the drawings, reference symbols A, A' denote grinding assemblies for grinding one width-wise half and the other width-wise half of a track rail R, respectively. A main body 1 of each of the grinding assemblies A, A' comprises a first to third grinding blade supporting portions 3A, 3B, 3C arranged at equiangular distances in its rotational direction, each grinding blade supporting portion having a recess edge 2 complementarily engaging with a head Ra of the track rail R. On the first to third grinding blade supporting portions 3A, 3B, 3C, as shown in FIGS. 2 to 4, detachably attached are a first grinding blade 4*a* for grinding an inner portion of a top face of the head Ra, a second grinding blade 4*b* for grinding an outer portion of the top face, a third grinding blade 4C for grinding an upper portion of an arc-like face of the head Ra, a fourth grinding blade 4*d* for grinding an intermediate portion of the half arc-like face, a fifth grinding blade 4*e* for grinding a lower portion of the arc-like face, a sixth blade 4*f* for grinding an upper portion of a side face of the head Ra, a seventh blade 4*g* for grinding an intermediate portion of the side face, and an eighth blade 4*h* for grinding a lower portion of the side face.

Figure 5:
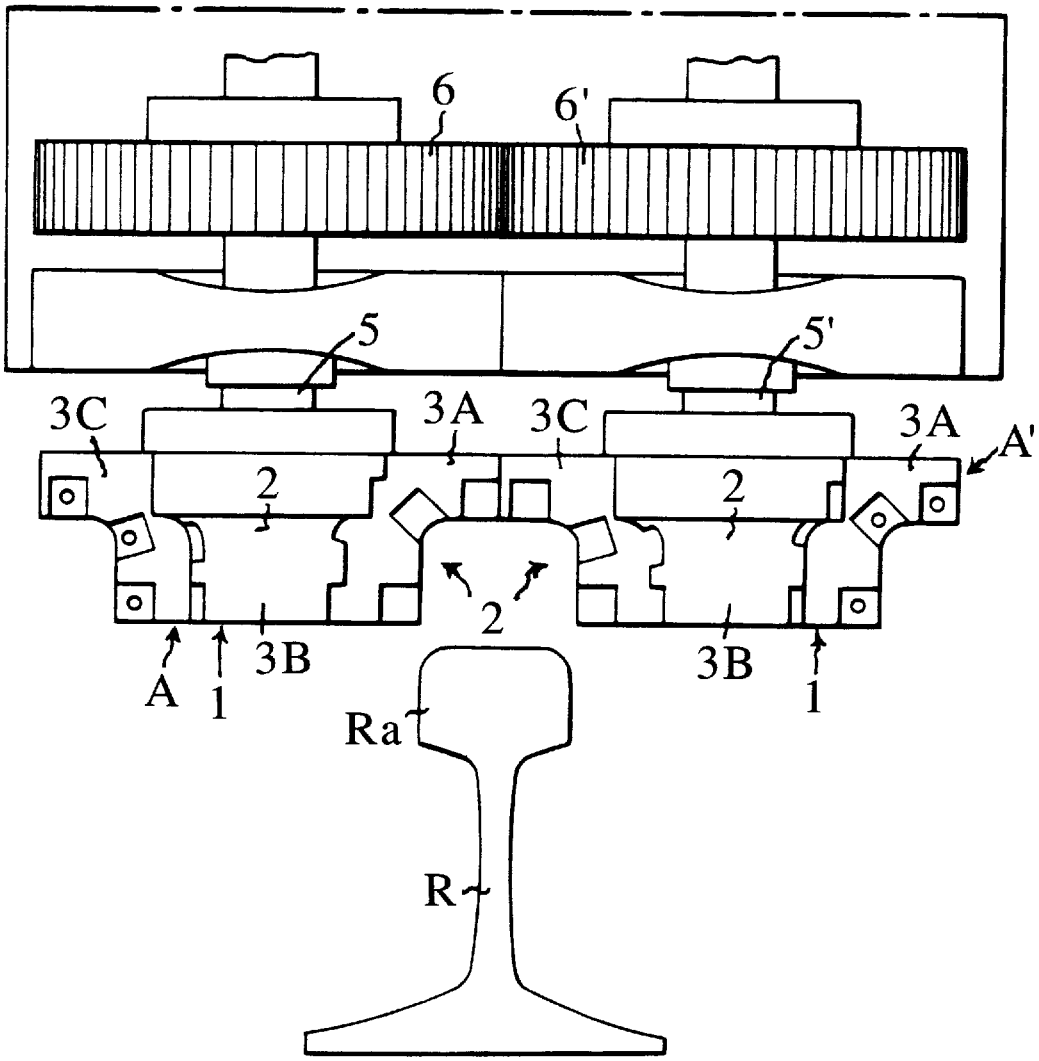
FIG. 5 is a front view showing a stage of use of the principal part of the track rail joint grinding apparatus.

The grinding assemblies A, A' are detachably mounted, respectively, on a pair of vertical shafts 5, 5' which are rotated through a motor as a driving source, and rotate at a uniform velocity through gears 6, 6' integrally attached to said shafts 5, 5' and engaging each other (See FIG. 5). In this manner, the present invention ensures that a joint of a rail head Ra is ground bilaterally uniformly, with the recess edges 2 engaging the rail head Ra complementarily.

The grinding assemblies A, A' are so constructed that the main bodies 1 are identical in contour between the two is grinding assemblies, but the first to eighth grinding blades 4*a* to 4*h* are different in position or direction between the two grinding assemblies. That is, the main body 1 has the first grinding blade supporting portion 3A, the second grinding blade supporting portion 3B, and the third grinding blade supporting portion 3C with their distal ends protruding in three directions, and then a first attaching portion 6*a* to an eighth attaching portion 6*h* corresponding to the first grinding blade 4*a* to the eighth grinding blade 4*h* are disposed on each of one group of edges 3A', 3B', 3C' and the other group of edges 3A", 3B", 3C" of the respective grinding blade supporting portions 3A, 3B, 3C with respect to the rotational directions of the grinding assemblies A, A'.

In concrete terms, on the edge 3A' of the first grinding blade supporting portion 3A disposed are the first attaching portion 6*a*, the fourth attaching portion 6*d*, and the eighth attaching portion 6*h* corresponding to the first grinding blade 4*a*, the fourth grinding blade 4*d*, and the eighth grinding blade 4*h*, respectively; on the edge 3B' of the second grinding blade supporting portion 3B disposed are the second attaching portion 6*b*, the fifth attaching portion 6*e*, and the seventh attaching portion 6*g* corresponding to the second grinding blade 4*b*, the fifth grinding blade 4*e*, and the seventh grinding blade 4*g*, respectively; and on the edge 3C' of the third grinding blade supporting portion 3C disposed are the third attaching portion 6*c* and the sixth attaching portion 6*f* corresponding to the third grinding blade 4*c* and the sixth grinding blade 4*f*, respectively.

On the edge 3B" of the second grinding blade supporting portion 3B disposed are the first attaching portion 6*a*, the fourth attaching portion 6*d*, and the eighth attaching portion 6*h* so as to correspond to those on the edge 3A' of the first grinding blade supporting portion 3A; on the edge 3C" of the third grinding blade supporting portion 3C disposed are the second attaching portion 6*b*, the fifth attaching portion 6*e*, and the seventh attaching portion 6*g* so as to correspond to those on the edge 3B' of the second grinding blade supporting portion 3B; and on the edge 3A" of the first grinding blade supporting portion 3A disposed are the fourth attaching portion 6*c*, and the sixth attaching portion 6*f* so as to correspond to those on the edge 3C' of the third grinding blade supporting portion 3C, respectively.

As described above, each of the group of edges 3A', 3B', 3C' and the group of edges 3A", 3B", 3C" of the grinding blade supporting portions 3A, 3B, 3C has the first to eighth attaching portions 6*a* to 6*h* provided in manner that correspondingly named attaching portions are opposed to each other with respect to the rotational directions of the grinding assemblies A, A' (for example, like the attaching portions 6*a*, 6*d*, 6*h* on the edge 3A' of the first grinding blade supporting portion 3A and those on the edge 3B" of the second grinding blade supporting portion 3B).

Then, one grinding assembly A is formed by attaching the grinding blades 4*a* to 4*h* to the respective attaching portions 6*a* to 6*h* of the group of edges 3A' to 3C' of the first to third grinding blade supporting portions 3A to 3B. The other grinding assembly A' is formed by attaching the grinding blades 4*a* to 4*h* to the respective attaching portions 6*a* to 6*h* of the group of edges 3A" to 3C" of the first to the third grinding blade supporting portions 3A to 3B.

Moreover, the main body 1 for the bases of the grinding assemblies A, A' are not limited in contour to the above-mentioned embodiment.

In the above embodiment, the edge 3A' of the first grinding blade supporting portion 3A and the edge 3B" of the second grinding blade supporting portion 3B correspond to each other, the edge 3B' of the second grinding blade supporting portion 3B and the edge 3C" of the third grinding blade supporting portion 3C correspond to each other, and the edge 3C' of the third grinding blade supporting portion 3C and the edge 3A" of the first grinding blade supporting portion 3A correspond to each other, and under this construction, a set of attaching portions 6*a* to 6*h* for the grinding blades 4*a* to 4*h* provided on one group of edges and a set of those provided on the other group of edges are disposed so as to be opposed to each other with respect to the rotational directions of the vertical shafts. However, in working the present invention, locations of the grinding blade attaching portions 6*a* to 6*h* are not limited to those in this embodiment. That is, the attaching portions 6*a* to 6*h* have only to be provided in manner that they are quantitatively identical as a whole between the group of edges 3A', 3B', 3C' and the group of edges 3A", 3B", 3C" of the grinding blade supporting portions 3A, 3B, 3C, with said opposing positions of the attaching portions duly taken with respect to the rotational directions of the vertical-shafts. (For example, the grinding blade attaching portion 6*a* as provided on the grinding blade supporting portions 3B" could be provided on another grinding blade supporting portion 3C" or 3A": the grinding blade attaching portion 6*a* as provided on the grinding blade supporting portion 3A' could be provided on another grinding blade supporting portion 3B' or 3C'.)

In this connection, each of the attaching portions 6*a* to 6*h* of this embodiment is, as shown in FIG. 2, provided by a notch portion formed by notching the grinding blade supporting portions 3A, 3B, 3C. A screw hole 8 is disposed on a bottom face of the notch portion, and then each of the fixing screws 9 penetrating through each of the grinding blades 4*a* to 4*h* made of cemented carbide (or ultra-hardmetal chips) is screwed into the screw hole 8 to thereby result in detachable attachment of the grinding blades 4*a* to 4*h*.

As described above, the present invention provides a main body of a grinding assembly which can be used for both width-wise sides of a track rail, for use in a track rail joint grinding apparatus comprising a pair of grinding assemblies rotating around vertical shafts in mutually opposite directions so as to grind one and the other width-wise halves of a track rail, each of the grinding assemblies comprising grinding blade supporting portions which each constitute a respective recess edge complementarily engaging with a head of the track rail, said grinding blade supporting portions being arranged at equiangular distances in the rotational direction of the vertical shaft, and a suitable number of grinding blades being detachably attached to grinding blade attaching portions of each of the grinding blade supporting portions.

What is claimed is:

1. A grinding apparatus for grinding railhead of track rail wherein the raihead when viewed in elevation has a cross sectional profile with a pair of opposite sides and a top portion, said apparatus comprising a pair of grinding assemblies, each said grinding assembly being rotatable about a respective rotational axis and said grinding assemblies being arranged side by side such that said respective rotational axes are parallel, each of said grinding assemblies including a main body for grinding a respective half portion of the railhead wherein each of the half portions of the railhead include one of said opposite sides of said railhead and approximately half of the top portion of the railhead, each said main body including at least three grinding blade support portions radially spaced apart an equivalent amount about said respective rotational axes, each said grinding blade support portion, when viewed in elevation, having a profile that is complementary to a corresponding said half portion of the railhead, each said grinding blade support portion having two radially spaced surfaces wherein one of said two radially spaced surfaces is a leading surface and the other of said two radially spaced surfaces is a trailing surface depending on the direction of rotation of the corresponding grinding assembly, each of said leading and trailing surfaces having a profile in elevation that is complementary to a corresponding said half portion of the railhead, a plurality of grinding blades being held on each of said leading and trailing surfaces such that said plurality of grinding blades on each of said leading and trailing surfaces are selectively positioned such that grinding of said railhead is accomplished by the grinding blades on each of the leading and trailing surfaces corresponding to each of the grinding blade support portions on each of the main bodies of the respective said grinding assemblies.

2. The grinding apparatus as claimed in claim 1 wherein each of said grinding assemblies is identical.

3. The grinding apparatus as claimed in claim 1 wherein each of said leading and trailing surfaces are symmetrical.

4. The grinding apparatus as claimed in claim 3 wherein each of said leading and trailing surfaces are symmetrical.

5. The grinding apparatus as claimed in claim 1 wherein said grinding blades are detachably secured to said leading and trailing surfaces.

6. The grinding apparatus as claimed in claim 1 wherein for one of said grinding blade support portions the grinding blades on the leading surface are in positions that differ from the positions of the grinding blades on the trailing surface.

7. The grinding apparatus as claimed in claim 1 wherein the grinding blades on the leading surface of one grinding blade support portion are in the same position as the grinding blades on the trailing surface of the next closest grinding blade support portion.

8. The grinding apparatus as claimed in claim 1 wherein for one of said grinding assemblies all of the grinding blades on respective leading surfaces are in different positions.

9. The grinding apparatus as claimed in claim 8 wherein the grinding blades on the respective leading surfaces of said one grinding assembly are positioned to collectively engage the entire profile of one of the half portions of the railhead.

10. The grinding apparatus as claimed in claim 1 wherein for one of the grinding assemblies all of the grinding blades on respective trailing surfaces are in different positions.

11. The grinding apparatus as claimed in claim 10 wherein the grinding blades on the respective trailing surfaces of said one grinding assembly are positioned to collectively engage the entire profile of one of the half portions of the railhead.

* * * * *